United States Patent [19]

Silvern et al.

[11] 3,976,390

[45] Aug. 24, 1976

[54] MEANS FOR CONTROLLING FLOW INSTABILITY IN CENTRIFUGAL COMPRESSORS

[75] Inventors: David H. Silvern, Hollywood; Stanley J. Minton, Woodland Hills, both of Calif.

[73] Assignee: Chicago Pneumatic Tool Company, New York, N.Y.

[22] Filed: Dec. 23, 1974

[21] Appl. No.: 535,163

[52] U.S. Cl. ..... 415/53 R; 415/DIG. 1; 415/122 R; 415/11

[51] Int. Cl.[2] ..... F04D 17/12; F04D 27/02

[58] Field of Search ..... 415/53 R, DIG. 1, 11, 415/122 R

[56] References Cited

UNITED STATES PATENTS

| | | | |
|---|---|---|---|
| 1,796,053 | 3/1931 | Schmidt | 415/1 |
| 3,041,848 | 7/1962 | Greenwald | 415/53 X |
| 3,741,676 | 6/1973 | Silvern et al. | 415/11 X |
| 3,741,677 | 6/1973 | Silvern et al. | 415/DIG. 1 |

FOREIGN PATENTS OR APPLICATIONS

| | | | |
|---|---|---|---|
| 1,043,168 | 9/1966 | United Kingdom | 415/DIG. 1 |

*Primary Examiner*—Arnold Rosenthal
*Attorney, Agent, or Firm*—Stephen J. Rudy

[57] ABSTRACT

A centrifugal air compressor having first and second stages together with means for recirculation, at a predetermined low level of flow, air of compression from the second stage simultaneously to the inlet passage of the rotor of the first stage and to the discharge passage of the rotor of the first stage in such manner that the injected air is admitted tangentially to the inlet passage and in the direction of the prevailing flow to the discharge passage, with the result of improved flow stability through the compressor being obtained.

3 Claims, 3 Drawing Figures

MEANS FOR CONTROLLING FLOW INSTABILITY IN CENTRIFUGAL COMPRESSORS

BACKGROUND OF THE INVENTION

This invention is concerned with means for controlling flow instability in a centrifugal fluid compressor, such as an air compressor.

Flow instability is known to develop in centrifugal air compressors in the usual exhaust diffuser area after the flow has left the rotor and also in the rotor itself prior to leaving the rotor. The results of such instability is manifested by rotor oscillation, undesirable vibrations, noise, whistling, and surging or uneven air flow from the compressor. The present invention is directed to improving the stability of air flow through the compressor so as to not only eliminate these faults, but also to improve the overall efficiency of the compressor.

In accordance with the present invention, there is provided in a centrifugal fluid compressor including a first stage of compression comprising a rotor having an inducer inlet, a volute diffuser connected to the discharge end of the rotor, and a primary inlet passage; and a second stage of compression comprising a second rotor having an outlet line connected with its discharge end, and an inlet line connecting with the discharge end of the volute diffuser; a loop conduit means for recirculating fluid of compression from the outlet line of the second stage of compression when flow through the compressor drops below a predetermined level simultaneously to the primary inlet passage upstream of the inducer inlet of the rotor of the first stage of compression and to the volute diffuser of the first stage.

DESCRIPTION OF PREFERRED EMBODIMENT

Figures 1, 2, 3:
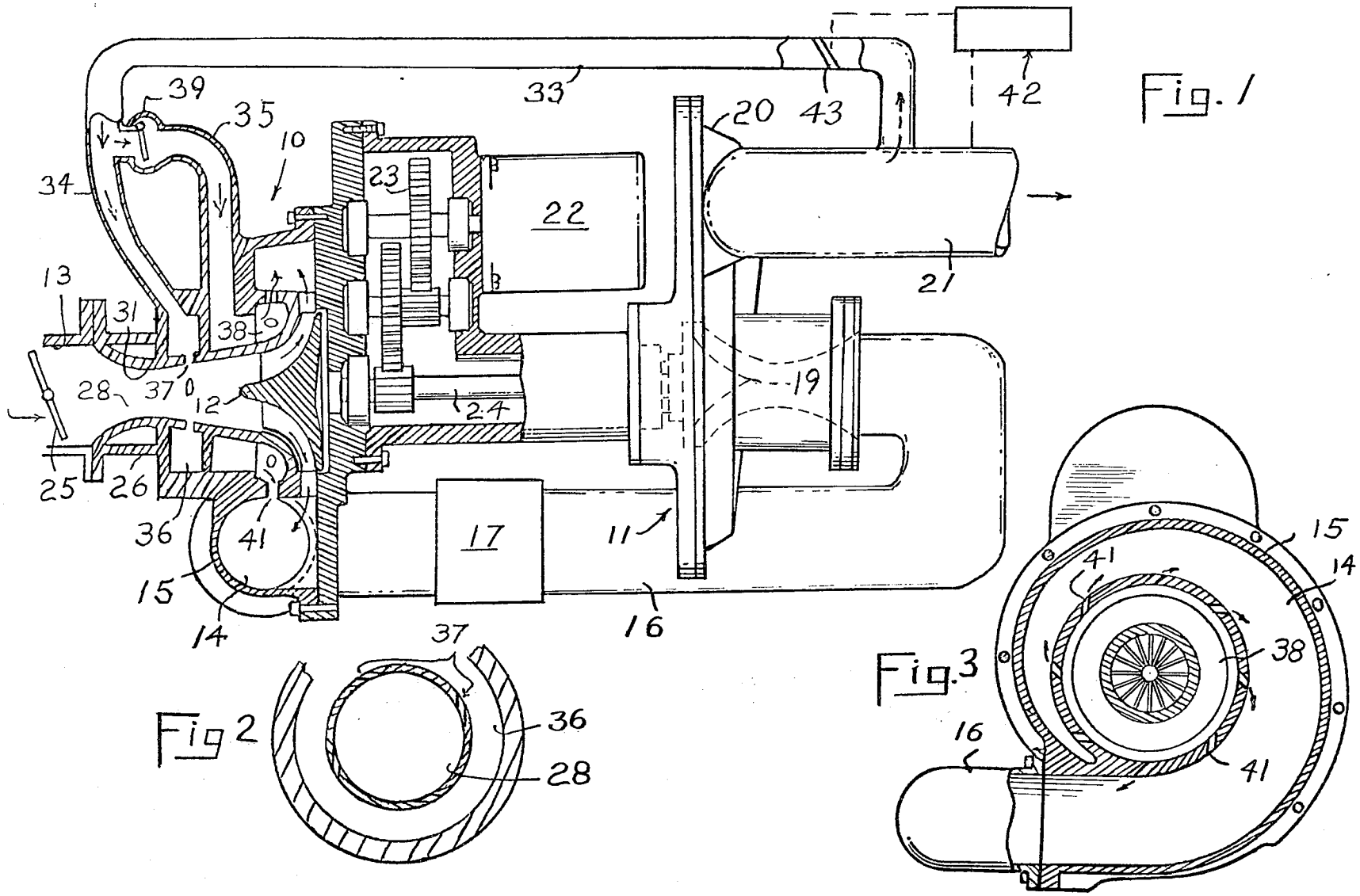
FIG. 1 is a partially cut-away view of a two-stage centrifugal compressor illustrating flow control means incorporated in the compressor in accordance with the present invention.
FIG. 2 is a sectional view of the first collection chamber of the first stage of compression.
FIG. 3 is a sectional view of the second collection chamber of the first stage of compression.

Now referring to the accompanying drawing, a centrifugal air compressor embodying the invention is shown for purposes of llustration as having two stages of compression, respectively designated 10 and 11.

The first stage 10 includes a rotor 12 which draws air through a primary inlet passage 13 and discharges the air in compressed condition into an exhaust passage 14 defined by a volute diffuser 15. The latter connects by means of a line 16 through a heat exchanger 17 with the inlet of a rotor 19 of the second stage of compression 11.

The rotor 19 discharges its air of compression into a second volute diffuser 20 which connects with a demand flow outlet line 21.

A motor 22 transmits its power through a gear train 23 and a common shaft 24 to drive both rotors.

Conventional controls are responsive to variations in flow pressure in the outlet line 21 above and below a predetermined value to cause a throttle valve 25 in the inlet passage to modulate inlet air flow to the compressor so that the air pressure at the demand outlet will obtain a substantially constant value.

A manifold 26 is connected in the inlet line between the throttle valve and the inducer inlet of the rotor of the first stage. The interior of the manifold defines a nozzle passage 28 in extension of the inlet passage 13. Nozzle passage 28 serves as an inlet diffuser, functioning in part to increase the velocity of inlet air flow to the rotor.

The nozzle passage 28 is defined by a pair of adjacent oppositely diverging coned surfaces, the inner ends of which define a throat at 31 through which inlet air admitted into one end of the nozzle passes at increased velocity to an opposite end of relatively larger diameter. The latter end of the nozzle merges with the inducer inlet to the rotor 12 of the first stage.

A loop line 33 is provided to recirculate at certain times air of compression from the outlet line 21 of the second stage 11 to both the inlet and exhaust ends of the first stage so as to improve the operating efficiency of the compressor, to avoid faults of surging or instability in the outlet flow of the compressor, and to avoid instability in flow through the rotor and its undesirable effects.

The recirculation loop 33 branches at one end from the outlet line 21 of the second stage. Line 33 divides at its other end into two branches 34 and 35. Branch 34 connects with an annular first collection chamber 36 formed about the wall of the nozzle passage 28. Chamber 36 in turn connects through a plurality of orifices 37 with passage 28. The orifices open tangentially into the passage 28 between the throat 31 and the rotor inlet at a point closer to the throat. By means of this construction, the recirculating compression air from the second stage, which is moving under higher pressure and velocity than inlet air passing through the throat 31, causes the inlet air to swirl and move with increased velocity and pressure into the inducer inlet of the rotor 12 of the first stage. The angular momentum or swirl imparted to the inlet flow serves to eliminate the aerodynamic stalling at the inlet to the rotor and the resultant oscillations that might otherwise develop when the flow into the compressor is small or at a low level. The angular momentum of the swirling air produced is transferred to the rotor and, thereby, also reduces the power consumed by the compressor.

Loop branch 35 connects with an annular second collection chamber 38 formed around the wall of the nozzle passage. Chamber 38 in turn communicates by means of orifices 41 with the volute passage 14. The orifices 41 extend tangentially into passage 14 in such manner that the air injected and passing through the orifices into passage 14 will merge with and be in the direction of the prevailing flow of air through passage 14. A check valve 39 in branch 35 prevents back flow from passage 14 to branch 34. The recirculated air injected from the second stage of compression into passage 14 of the first stage through the orifices 41 is at a higher pressure than that being discharged from the rotor 12 of the first stage. This has the effect of greatly reducing the effects of surging and uneven flow in the compressor.

Conventional controls 42 are responsive to the pressure in the outlet line 21 of the second stage so as to control operation of a control valve 43 in the loop line 33 to regulate the amount of air that may be recirculated through the loop to the first stage of compression. As the demand for outlet air from the compressor is decreased, more air is allowed to recirculate to the first stage by way of collection chambers 36 and 38. When the compressor is operating at its optimum or predetermined flow, the control valve 43 may be completely closed so that no air from the outlet will be flowing through the loop to the lower first stage. And, as the flow from the outlet decreases below its optimum or a predetermined value, control valve 43 opens allowing air from the outlet of the second stage to recirculate through the collection chambers to both the inlet passage 28 forwardly of the first stage rotor inlet, and to the volute passage 14 at the discharge end of the rotor of the first stage.

We claim:

1. In a centrifugal air compressor including a first stage of compression comprising a first rotor having an inlet, a discharge volute connected to a discharge end of the rotor, a primary inlet passage, and a nozzle passage connecting the primary inlet passage with the inlet of the rotor; and a second stage of compression comprising a second rotor having an inlet connecting with a discharge end of the volute, and having a discharge end connecting with a demand outlet line; the improvement represented by recirculation means for recirculating high energy air of compression from the demand outlet line of the second stage to the first stage when flow through the compressor drops below a predetermined value, said recirculation means comprising a loop conduit, a first collection chamber around the wall of the nozzle passage, a second collection chamber around the wall of the nozzle passage, the loop conduit having a connection at one end with the demand outlet and dividing at its other end into a pair of branch lines, a first of the branch lines connecting with the first collection chamber, a second of the branch lines connecting with the second collection chamber, a first group of orifices connecting the first collection chamber tangentially with the nozzle passage and normal to the direction of flow through the latter passage at a point between the throat of the nozzle passage and the inlet to the first rotor whereby a swirling motion is imparted to air flow through the nozzle passage, and a second group of orifices connecting the second collection chamber with the discharge volute in the direction of prevailing flow through the volute.

2. In a centrifugal air compressor having multiple successive stages of compression each including a rotor, a discharge volute and an inlet passage to the rotor, means for preventing air flow instability through the compressor by recirculating high energy air of compression from a higher stage to a lower stage comprising a loop conduit connected at one end to the outlet of a higher stage and having an opposite double branched end, one branch being connected by a first group of orifices extending tangentially to the direction of flow into the inlet passage to the rotor of the next lower stage; and the other branch being connected by a second group of orifices extending into the discharge volute of said lower stage in the direction of prevailing flow through the latter volute.

3. In a centrifugal compressor as in claim 2, wherein a nozzle passage is connected as an entrance to the inlet passage to the rotor of the said lower stage and the first group of orifices connect with the nozzle passage at a point between the throat of the nozzle passage and the inlet passage to the said rotor of the lower stage.

* * * * *